United States Patent [19]

Booth

[11] 3,940,719

[45] Feb. 24, 1976

[54] MICROWAVE WAVEGUIDE DISSIPATIVE LOAD COMPRISING FLUID COOLED LOSSY WAVEGUIDE SECTION

[75] Inventor: Alfred E. Booth, Marlboro, Mass.

[73] Assignee: Raytheon Company, Lexington, Mass.

[22] Filed: Oct. 25, 1974

[21] Appl. No.: 518,019

[52] U.S. Cl. ..... 333/22 F; 333/81 B
[51] Int. Cl.[2] ..... H01P 1/22; H01P 1/26
[58] Field of Search ..... 333/22 R, 22 F, 81 B, 95 R

[56] References Cited

UNITED STATES PATENTS

| | | | |
|---|---|---|---|
| 3,205,459 | 9/1965 | Adams | 333/22 R |
| 3,587,009 | 6/1971 | Kibler | 333/95 R |

*Primary Examiner*—Paul L. Gensler
*Attorney, Agent, or Firm*—Edgar O. Rost; Joseph D. Pannone; Harold A. Murphy

[57] ABSTRACT

An electromagnetic energy dissipative load or attenuator is provided having a lossy section of waveguide transmission line of sufficient length to provide substantial loss and a transition section for adaption to other waveguide configurations. The transmission line is short circuited as a terminating load, and cooling means may be circulated adjacent to the waveguide for removal of the heat energy generated in the waveguide walls. A second transition section in place of the short circuit provides for a high power attenuator. The lossy waveguide section is coiled in either a flat spiral or concentric helical configuration. A fluid coolant may be circulated adjacent to or inside the lossy section coils.

9 Claims, 5 Drawing Figures

MICROWAVE WAVEGUIDE DISSIPATIVE LOAD COMPRISING FLUID COOLED LOSSY WAVEGUIDE SECTION

BACKGROUND OF THE INVENTION

1. Field of the Invention

The invention relates to transmission line devices for absorbing microwave energy.

2. Description of the Prior Art

In transmission systems for propagation of microwave energy, the problems of termination of such systems raises problems with respect to dissipation of heat with high average and peak pulse power levels of energy. Impedance matching, bandwidth and voltage standing wave ratio (VSWR) are important factors to be considered in providing for substantially wave-reflectionless characteristics with absorbing devices. In addition a microwave dissipative load is frequently required in the art for measurement of high average power levels utilizing well known calorimetric techniques.

Loads of the type disclosed in U.S. Pat. No. 3,044,027, issued July 10, 1962 to D. D. Chin et al, provide for the circulation of a liquid which becomes heated upon the impingement of the microwave energy and the rise in temperature is calibrated to provide a corresponding reading indicative of the power level. Another example of prior art teaching is found in U.S. Pat. No. 3,597,708, issued Aug. 3, 1971 to Henry W. Perreault, and assigned to the assignee of the present invention. In this embodiment a coolant is circulated through concentrically disposed conductive members to define a coaxial reentrant folded-line path whereby the overall length of the load is substantially reduced. Other embodiments of prior art teachings include energy absorption means, such as silicon carbide provided in a wedge form, having a surrounding cooling jacket for removal of the generated heat. Other suggested embodiments in the prior art include the provision of a quarter-wave window block of a dielectric material together with means for directing a stream of a dielectric liquid over the face of the block for absorbing the microwave energy absorbed from the source.

All of the prior art embodiments are substantially costly in implementation and some have cumbersome overall lengths. The problem of providing a suitable dissipative load becomes increasingly important in the handling of high powers in very high frequencies with very short wavelengths, for example, the eight millimeter band with frequencies in the 30 thousand MHz range where the waveguide is exceedingly small and conventional load techniques cannot be implemented. In addition to the power absorption characteristics, a load must provide for impedance matching to the transmission line which is reasonably independent of temperature, as well as being relatively insensitive to surrounding environmental conditions. Voltage standing wave ratio (VSWR) ratings of the load terminations should also be less than 1.2 in order to be acceptable. A need arises, therefore, for the provision of new and novel dissipative load structures having high average and peak power handling capabilities over a reasonably broad frequency band for use in the very, ultra and super high frequency portions of the electromagnetic energy spectrum.

Summary of the Invention

In accordance with the teachings of the present invention a dissipative load is provided incorporating transition means from a main waveguide line to a lossy waveguide section. The lossy section, is an illustrative embodiment, is fabricated of a poor electrically conductive material, such as stainless steel, with a short circuit provided for terminating a waveguide transmission line. The lossy waveguide is concentrically coiled to form a helix having a length sufficient to provide for a lossy reentrant helical path and a maximum VSWR under 1.2. In an exemplary embodiment 14½ turns of a cylindrical waveguide helix wound on a mandrel of approximately 3 inch diameter provided a one-way loss of approximately 20 db at 36 thousand MHz.

The heat generated in the structure disclosed herein may be dissipated by fluid coolant means circulated in a jacket formed by concentric cylindrical members disposed inside and outside of the helically coiled lossy waveguide section. Any suitable liquid or gas coolant circulated in the chamber of the concentric cylinder jacket arrangement conducts the heat generated in the guide wall interface by the propagating microwave energy. Where desired, the load may be pressurized both inside the waveguide and in the cooling region to provide compatibility with a transmission system. Additionally, the short circuit wall member may be provided with a gas coupling connection and operating the load with a gas coolant flowing through the helix. Another variation of the invention includes the use of a wide range of fluids for cooling since the cooling fluid plays no part in the absorption of energy. Hence, fluids, including gas and liquids, could be provided around the lossy waveguide structure. An alternative embodiment of the invention includes the removal of the short circuit plate and the addition of another transition structure to rectangular guide to thereby provide a high power attenuator for waveguide transmission systems. Monitoring of the flow and temperature rise of the circulating coolant fluid makes it possible for the disclosed load to be utilized for calorimetric measurement of average power.

An illustrative transition structure from rectangular to cylindrical waveguide in the $TE_{11}$ mode is the oval iris quarter-wave transformer arrangement. In addition to the provision of a concentric helical coil arrangement the load may be provided by means of a flat spiral arrangement which may be cooled by a contiguous coil arrangement on either or both sides of the coiled waveguide for the circulation of coolant fluids. Alternatively, the flat spiral may be cooled in a manner similar to the helix arrangement with a coolant chamber. In low power applications the disclosed load structure can be provided without any additional cooling since radiation from the walls of the lossy waveguide section may suffice. In the exemplary embodiment for utilization in the 30 thousand MHz microwave region, the coiled lossy waveguide section and fluid coolant jacket comprising the load was provided in a complete package having an overall length of 7 inches and a diameter of 5 inches. With the circulation of a liquid coolant, such as water, the power handling capability of this embodiment was rated for approximately twenty thousand watts peak and two thousand watts average with a VSWR characteristic of less than 1.20.

BRIEF DESCRIPTION OF THE DRAWINGS

Details of an illustrative embodiment of the invention will be readily understood after consideration of the following description, with reference being directed to the accompanying drawings, wherein.

DESCRIPTION OF THE PREFERRED EMBODIMENT

Figure 1:
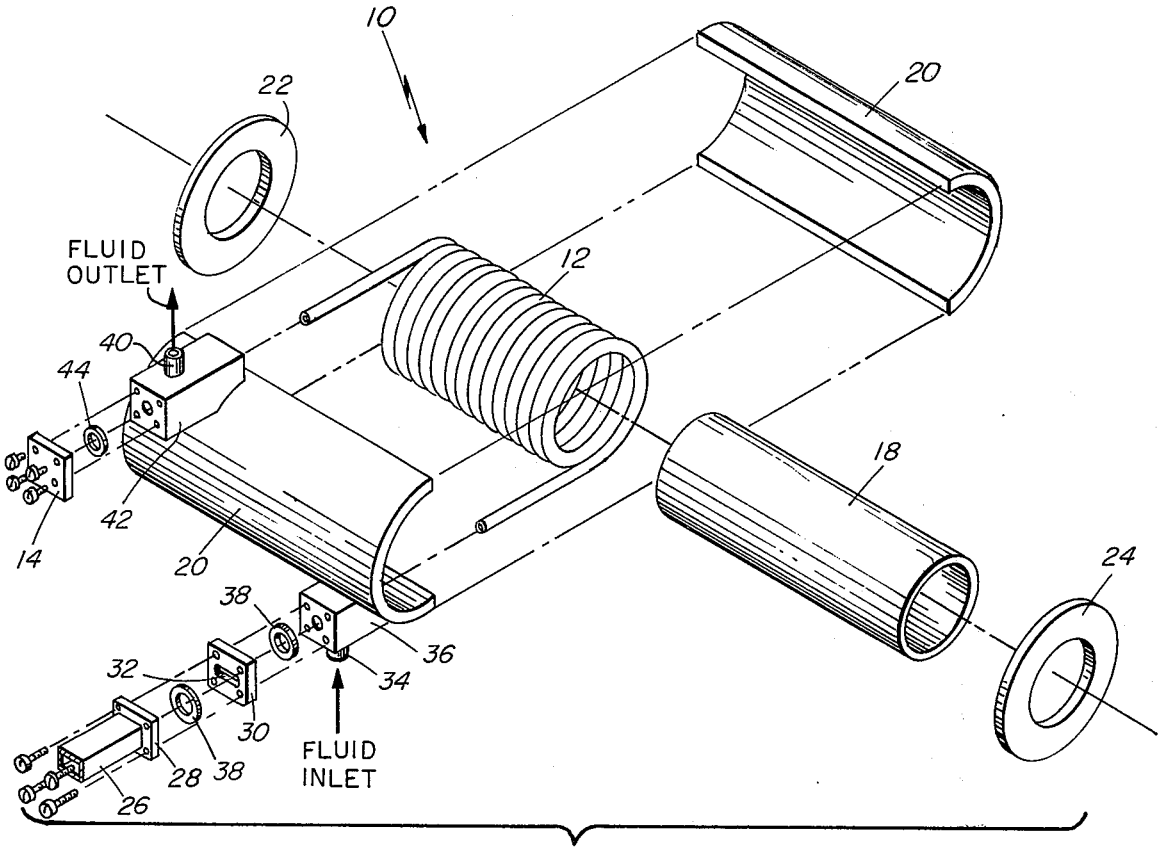
FIG. 1 is an exploded view of the illustrative embodiment of the invention.
Figure 2:
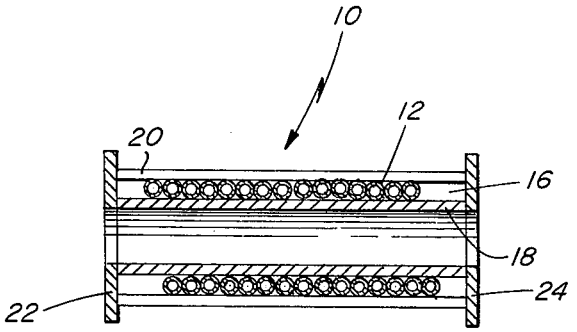
FIG. 2 is a longitudinal cross-sectional view of the embodiment illustrated in FIG. 1.
Figure 3:
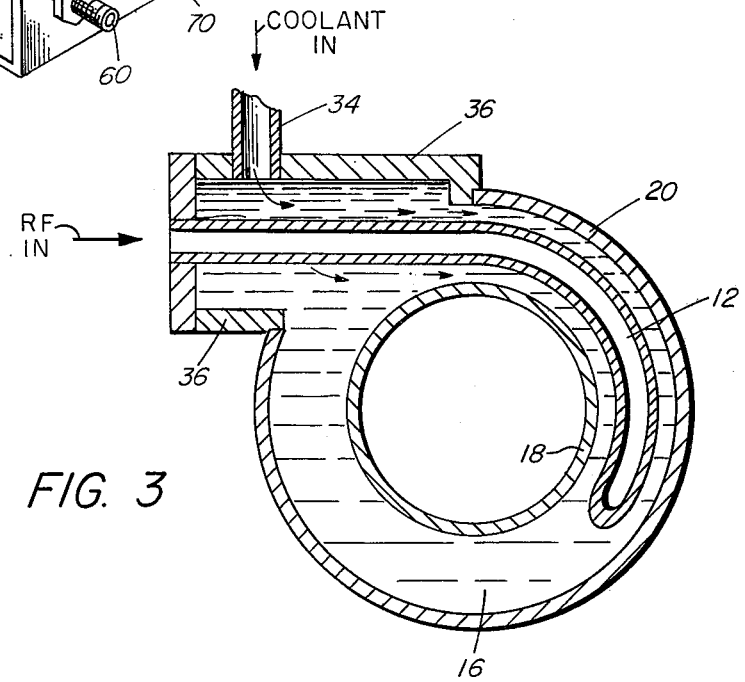
FIG. 3 is an end view, partially in section, of the embodiment illustrated in FIGS. 1 and 2.

Referring to FIGS. 1–3 inclusive of the drawing, the embodiment of the invention shown comprises a dissipative load 10 having a lossy helical waveguide section 12 of a poor electrically conductive material terminating in a short circuit provided by means of wall member 14. The lossy cylindrical waveguide section 12 has an overall length sufficient to provide a substantial loss with a minimum of reflection from the short circuit member and VSWR characteristics in the range of 1.01 to 1.2, maximum, for microwave energy traversing the reentrant waveguide path. In an exemplary device in the very high frequency range of the electromagnetic energy spectrum, a helix having an inside diameter of approximately 3 inches and 14½ turns had an overall length of 14 feet to provide a one way loss of approximately 20 db. Average high power levels in excess of one thousand watts continuous wave operation were handled with a liquid fluid coolant, such as water.

The fluid coolant is circulated to remove the heat generated in the walls of cylindrical waveguide 12 within a chamber 16 defined by a first cylindrical member 18 disposed inside the cylindrical waveguide helix 12. A second cylindrical member 20 formed by half cylindrical sections surrounds the outer portion of waveguide helix 12. End plates 22 and 24 are secured to the ends of cylinders 18 and 20 to provide the fluid-tight chamber 16. The waveguide helix coils are preferably trapped loosely by the cylinders 18 and 20 to allow for expansion and contraction of the helix coils during operation of the load.

Energy is coupled to the load cylindrical waveguide section 12 from a main transmission line, such as rectangular waveguide 26 having a mating flange 28. An input quarter-wave transition section 30 converts the waves in the rectangular mode, $TE_{10}$, to a cylindrical mode, $TE_{11}$, for propagation in the cylindrical waveguide section 12. The quarter-wave transformer transition section includes an oval iris 32 fabricated in accordance with the teachings found in the text "Microwave Transmission Circuits", edited by George L. Ragan, Vol. 9, Radiation Lab. Series, McGraw Hill Book Company, Inc., New York, 1948, page 366. The cylindrical waveguide section 12, as well as the concentric cylinders 18 and 20, end plates 22 and 24, together with all appended components for the short circuit and input and output fluid coolant circulation means, are fabricated of a poor electrically conductive material, such as stainless steel, which also maintains its strength at high temperatures. The input transition section 30 is soft copper in an exemplary embodiment to provide good RF contact from the rectangular waveguide 26 into the circular waveguide 12.

Fluid coolant inlet means 34 are incorporated in a block 36 appended to cylinder 20. The block 36 is hollowed so that coolant is provided to the outer wall of cylindrical waveguide section 12 immediately behind the input face of the block 36. O-ring member 38 seated on the face of the transition section 30 and block 36 provides for pressurization of the system. Fluid is removed by means of outlet means 40 in hollowed block 42 appended to cylinder 20. For the terminal load applications the end of the cylindrical waveguide section 12 is short circuited by means of wall member 14 secured to block 42. Another O-ring 44 is provided similar to ring 38.

In the practice of the invention considerable versatility is noted in that, for example, the short circuiting wall member 14 may be removed and another transition quarter-wave transformer section can be substituted so that the overall device now becomes a high power attenuator. The disclosed load further provides for the input transition section to be a separate element which can be replaced if the original becomes damaged or a change in frequency range is desired. Further, by monitoring the flow and temperature rise of the fluid coolant the disclosed embodiment may be utilized for calorimetric power measurements. The disclosed embodiment is also capable of operation with high pressure to provide compatibility with pressurized waveguide transmission systems to which the load is appended. The short circuiting wall member 14 may be provided with a gas fitting so that the fluid coolant, such as a gas, may flow directly through the cylindrical waveguide helix section, as well as the chamber 16. Other fluid coolants may also be selected in view of the fact that the microwave energy absorption process is handled by the cylindrical waveguide walls and the fluid, which only serves to remove the heat, need not be a wave attenuative type liquid, such as water. The overall embodiment may, therefore, be cooled by whatever means is desired and, depending on the amount of power within the system to be terminated, the user may select the appropriate fluid coolant or no fluid coolant may be required in the instance of the lower power levels. The stainless steel cylindrical waveguide which provides for the high microwave energy absorption is preferably seamless which reduces the possibility of arcing at high power levels. The stainless steel material is also capable of handling very high temperatures without sacrificing strength.

Figure 4:
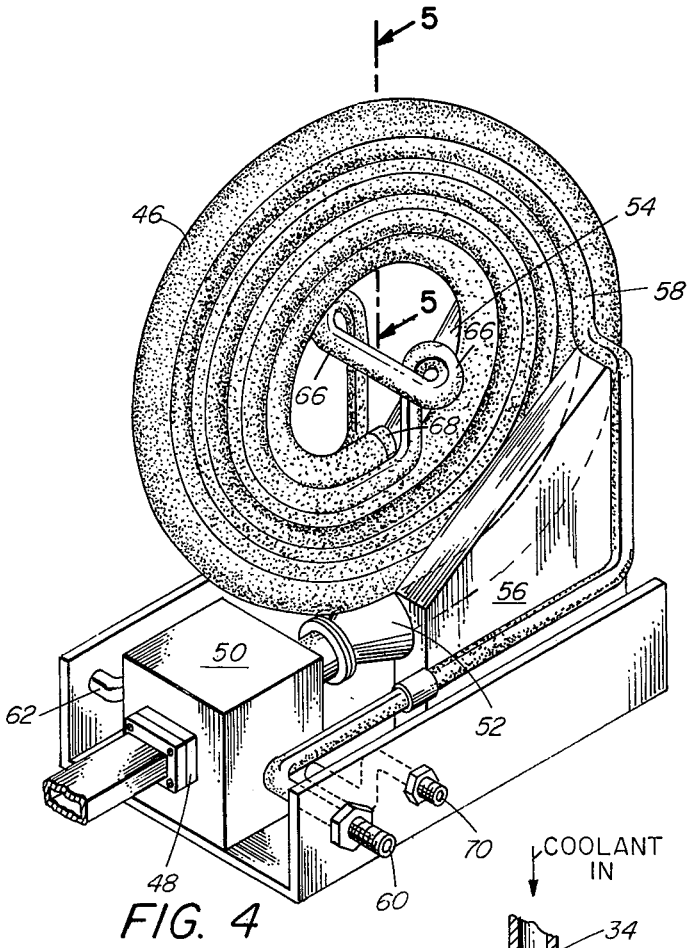
FIG. 4 is an isometric view of an alternative embodiment of the invention.
Figure 5:
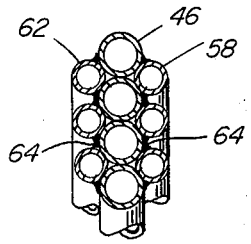
FIG. 5 is a cross-sectional view taken along the line 5—5 in FIG. 4.

Referring now to FIGS. 4 and 5 another configuration of the embodiment of the invention is illustrated, referred to as the flat spiral type. In this structure the cylindrical waveguide is coiled as a flat spiral 46 of a sufficient length to provide the desired loss characteristics. The transition structure from rectangular waveguide abutting flange 48 of block 50 is handled through a conventional tapered rectangular-to-cylindrical transition. A conical cooling collar 52 may be provided. Mounting blocks 54 and 56 provide for the support of the coiled waveguide and fluid coolant conduit means 58 having coupling means 60. Referring to FIG. 5 it will be noted that the coils of the fluid conduit means 58 are disposed between the turns of the coils of the cylindrical waveguide section 46. To provide for cooling on both sides of the cylindrical waveguide section 46 a second fluid conduit means 62 is disposed on the opposing walls of the spiral waveguide section 46. To assist in the heat removal process the oppositely disposed fluid coolant means for 58 and 62 may be soft soldered as at 64 to the turns of the spiral cylindrical waveguide section. The fluid coolant means 58 and 62 are interconnected by a cross-over section 66 in the center of the spiral waveguide section to provide for the continuous flow of the fluid coolant. The cylindrical waveguide is terminated by a flat short circuit wall member 68 for those applications requiring a terminating load. The capability of circulating a gas coolant is also provided in this embodiment by conduit means 70 for introduction of the gas within the cylindrical waveguide helix 46.

There is thus disclosed a unique microwave energy transmission line device having a lossy cylindrical waveguide section of a poor electrically conductive material in either a helix or flat spiral arrangement with fluid coolant means circulated adjacent to the turns of the cylindrical waveguide for removal of the generated heat. The device is implemented in a relatively small package so that it is ideally suited as a terminating load or attenuator. Numerous alternative and modified embodiments may be practiced by those skilled in the art. The foregoing detailed description of the illustrative embodiment, therefore, is to be considered in its broadest aspects and not in a limiting sense.

What is claimed is:

1. A microwave energy dissipative load device comprising:

a lossy section of waveguide transmission line of a poor electrically conductive non-magnetic material;

transition means adapted for coupling said lossy waveguide section to a main waveguide transmission line; and means for circulating a fluid coolant adjacent to the walls of said lossy waveguide section for removing thermal energy generated by absorption of microwave energy.

2. A microwave device according to claim 1 wherein said lossy waveguide section is terminated by a short circuit wall member.

3. A microwave device according to claim 1 wherein said fluid coolant comprises a liquid.

4. A microwave device according to claim 1 wherein said fluid coolant comprises a gas.

5. A microwave device according to claim 1 wherein: said lossy waveguide section comprises a cylindrical waveguide helix.

6. A microwave device according to claim 5 wherein said fluid coolant circulation means comprise wall members defining a fluid-tight chamber surrounding said waveguide helix.

7. A microwave device according to claim 1 wherein said lossy waveguide section comprises cylindrical waveguide having a flat spiral coiled configuration.

8. A microwave device according to claim 7 wherein said fluid coolant circulation means comprise coiled conduit means disposed adjacent to the cylindrical waveguide spiral coils.

9. A microwave energy transmission line termination load device comprising:

a lossy section of cylindrical waveguide transmission line of a poor electrically conductive material;

a short-circuiting wall member terminating one end of said lossy waveguide section;

transition means including a substantially oval iris quarter-wave transformer member for coupling said lossy waveguide section to a rectangular waveguide transmission line;

means including first and second cylindrical members and end plate members surrounding said lossy waveguide helix section and defining a fluid-tight chamber; and means for circulating a fluid coolant within said chamber.

* * * * *